US009321106B2

(12) United States Patent
Godon et al.

(10) Patent No.: US 9,321,106 B2
(45) Date of Patent: Apr. 26, 2016

(54) PROCESS FOR MANUFACTURING A ONE-PIECE AXISYMMETRIC METALLIC PART FROM COMPOSITE FIBROUS STRUCTURES

(75) Inventors: Thierry Godon, Sevran (FR); Bruno Jacques Gerard Dambrine, Le Chatelet en Brie (FR)

(73) Assignee: SNECMA, Paris (FR)

( * ) Notice: Subject to any disclaimer, the term of this patent is extended or adjusted under 35 U.S.C. 154(b) by 331 days.

(21) Appl. No.: 14/004,555

(22) PCT Filed: Mar. 15, 2012

(86) PCT No.: PCT/FR2012/050550

§ 371 (c)(1),
(2), (4) Date: Sep. 11, 2013

(87) PCT Pub. No.: WO2012/123686

PCT Pub. Date: Sep. 20, 2012

(65) Prior Publication Data

US 2013/0340241 A1 Dec. 26, 2013

(30) Foreign Application Priority Data

Mar. 15, 2011 (FR) ..... 11 52129

(51) Int. Cl.

| | |
|---|---|
| ***B22F 3/15*** | (2006.01) |
| ***C22C 47/04*** | (2006.01) |
| ***C22C 47/06*** | (2006.01) |
| ***B22F 3/00*** | (2006.01) |

(52) U.S. Cl.

CPC . *B22F 3/15* (2013.01); *B22F 3/002* (2013.01); *C22C 47/04* (2013.01); *C22C 47/064* (2013.01); *Y10T 29/49989* (2015.01)

(58) Field of Classification Search

CPC ..... B22F 3/15; B22F 3/002; C22C 47/064; C22C 47/04; Y10T 29/49989

See application file for complete search history.

(56) References Cited

U.S. PATENT DOCUMENTS 6,786,389 B2 * 9/2004 Pursell ..... C22C 47/00 228/165
2003/0029904 A1 2/2003 Pursell

FOREIGN PATENT DOCUMENTS

| | | |
|---|---|---|
| EP | 1 288 324 | 3/2003 |
| JP | 6 256869 | 9/1994 |

OTHER PUBLICATIONS

International Search Report Issued May 14, 2012 in PCT/FR12/050550 filed Mar. 15, 2012.

* cited by examiner

*Primary Examiner* — Richard Chang
(74) *Attorney, Agent, or Firm* — Oblon, McClelland, Maier & Neustadt, L.L.P.

(57) ABSTRACT

A process for manufacturing a one-piece axisymmetric part includes: superposition, around a rotating cylindrical mandrel of at least respectively inner and outer metal-coated composite fibrous structures, wound in first and second crossed directions on the mandrel; arranging, between the crossed inner and outer fibrous structures, at least one layer of metallic wire; then placing a blank of the part, formed by the fibrous structures and the layer of metallic wire, in a tool to apply to the blank a hot isostatic pressing treatment, and to obtain the part.

10 Claims, 3 Drawing Sheets

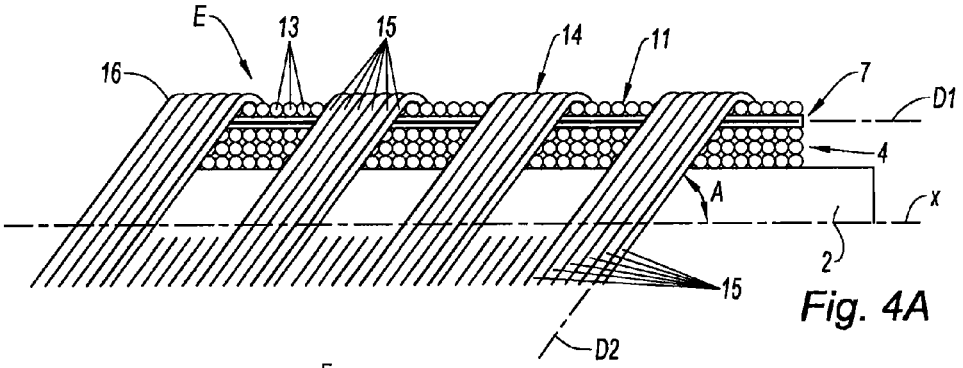
Fig. 4A
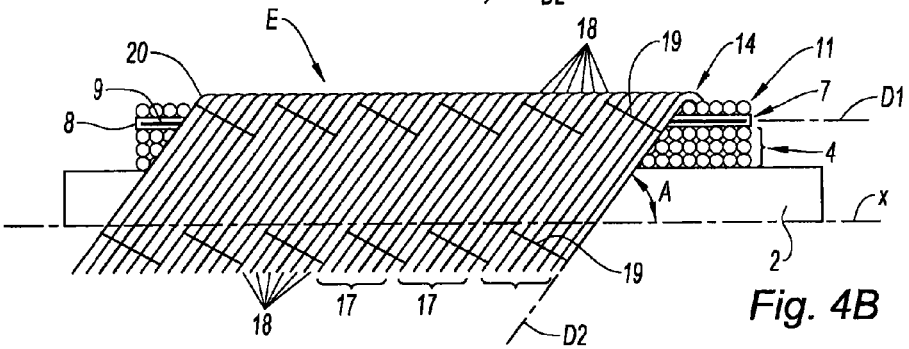
Fig. 4B
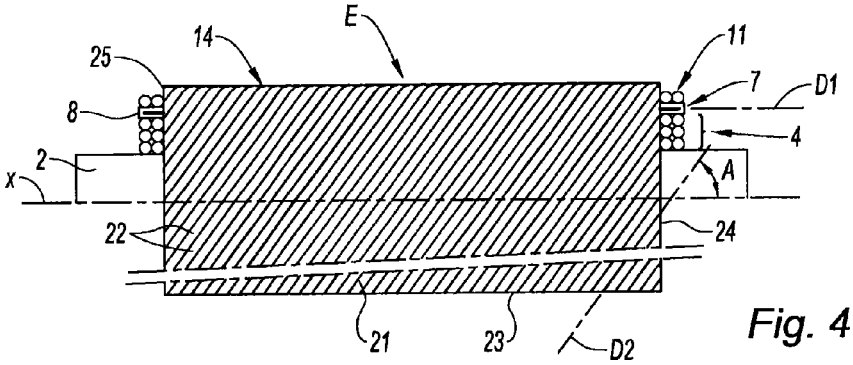
Fig. 4C1
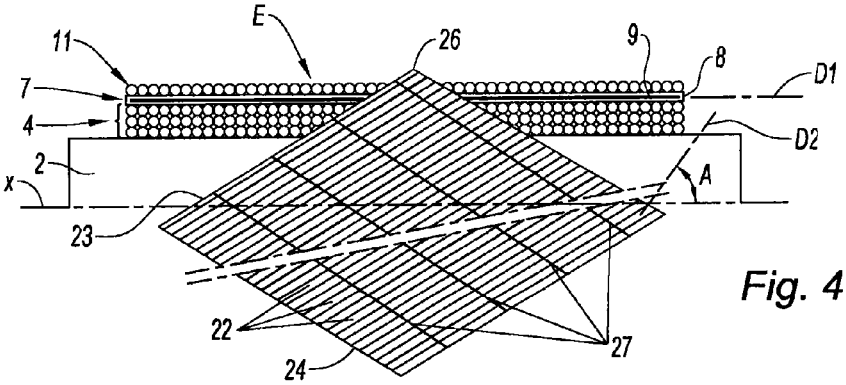
Fig. 4C2

PROCESS FOR MANUFACTURING A ONE-PIECE AXISYMMETRIC METALLIC PART FROM COMPOSITE FIBROUS STRUCTURES

BACKGROUND OF THE INVENTION

1. Field of the Invention

The present invention relates to a method for manufacturing an integral rotationally symmetrical metal part from composite fibrous structures in the form of fibers, fiber laps, fiber fabrics and similar, coated with metal.

2. Description of the Related Art

The importance of composite materials in the partial or total production of parts has emerged in recent years, in many technical fields, notably aeronautics, space, military, automobile, etc., because of the optimization of the resistance of such materials, for minimal weight and bulk. As a reminder, such a structure comprises metal composite fibers composed of a metal alloy matrix, by example titanium Ti alloy, within which extend fibers, for example ceramic fibers of silicon carbide SiC. Such fibers exhibit a tensile strength much greater than that of titanium (typically, 4000 MPa compared to 1000 MPa). It is therefore the fibers which take up the forces, the metal alloy matrix acting as a binder for the part, and providing protection and insulation for the fibers, which must not come into contact with one another. Furthermore, the ceramic fibers are resistant to erosion, but necessarily have to be reinforced with metal.

These composite materials can be used to produce annular, rotationally symmetrical gas turbine parts for aircraft or other industrial applications, such as rings, shafts, cylinder bodies, casings, spacers, monolithic part reinforcements such as blades, etc.

The known methods for manufacturing such integral rotationally symmetrical parts consist in superposing, around a rotary cylindrical mandrel, successive fibrous structures (fibers, fiber lap or fiber fabric) and then arranging the composite fibrous structures, wound and removed from the mandrel in a specific receiving outfit for them to be heat treated and to ultimately obtain the rotationally symmetrical part made of composite material.

For the rotationally symmetrical part to be particularly rigid and withstand forces in different directions, notably torsional forces, one of the superposed fibrous structures is oriented in a first winding direction relative to the longitudinal axis of the mandrel, then the other fibrous structure is wound on the preceding one in a second winding direction different from the first, so as to obtain two composite fibrous structures that have crossed winding directions.

However, it has been noted that crossing over the metal-coated ceramic composite fibers of the two fibrous structures superposed one on top of the other could create excessive local stresses which occur during the cooling of the part, after the creep of the thin metal cladding of the fibers of the structures. These excess stresses drastically reduce the mechanical characteristics of the part.

BRIEF SUMMARY OF THE INVENTION

The aim of the present invention is to remedy these drawbacks.

To this end, the method for manufacturing an integral rotationally symmetrical part by superposition, around a rotary cylindrical mandrel, of at least two metal-coated composite fibrous structures, respectively inner and outer, wound in first and second directions crossed on said mandrel, is noteworthy in that it consists:

- in arranging, around the inner fibrous structure constructed on the mandrel in the first winding direction, at least one layer of metal wire,
- in winding, on said layer of metal wire, the outer fibrous structure in the second winding direction,
- in placing the preform of said part, formed by the fibrous structures and the layer of metal wire, in a receiving outfit to apply to the preform a hot isostatic compaction or isothermal forging treatment, and
- in extracting the treated preform from the outfit, and if appropriate, machining the treated preform to obtain said part.

Thus, by virtue of the invention, the layer of metal wire serves as interface between the superposed and crossed fibrous structures and increases the metal thickness between the structures, so that the excess stresses between the composite fibers of the structures no longer occur.

Advantageously, the metal wire is obtained, for example, by wire drawing and is of the same nature as the metal of the composite fibrous structures, so that there is obtained, after passage through the outfit, an intermediate and uniform metal layer that has an appropriate thickness between the fibers of the structures. However, the wire could be obtained other than by wire drawing. A "metal wire" should be understood to mean equally one and the same continuous wire and a plurality of wires placed end to end. The metal wire can also be individual or take the form of a lap or a band of a plurality of parallel or interlaced wires, a cable, a fabric of unidirectional wires, etc., without departing from the framework of the invention.

Preferably, the superposed winding layers of the metal wire and of the fibrous structures are made cold, at ambient temperature, which does not require any complex installation for the implementation of the relevant steps of the method.

Furthermore, the metal wire is wound substantially orthogonally to the longitudinal axis of the rotary cylindrical mandrel to form the layer of contiguous turns.

To insulate and protect the inner fibrous structure from the outside, at least one layer of metal wire, on which the inner fibrous structure is subsequently wound, can be arranged around said cylindrical mandrel, before the placement of the inner fibrous structure.

For the same purpose, at least one layer of metal wire can be arranged around the outer fibrous structure, so that the part obtained has, on the surface, a thickness of outer and inner metal layers.

According to an exemplary embodiment, the first winding direction of the inner fibrous structure is oriented at an angle relative to the longitudinal axis of the cylindrical mandrel, the second winding direction of the outer fibrous structure then being oriented symmetrically to the first relative to a radial direction of the mandrel, at right angles to its longitudinal axis. For the range of values, if the winding direction of the inner fibrous structure is between 30°-60° relative to the longitudinal axis of the mandrel, the winding direction of the outer structure will be between $30°-60°+\pi/2$.

In this example, the inner and outer fibrous structures may be in the form of individual and parallel fibers wound in succession around the mandrel, or in the form of laps or strips of parallel fibers, or in the form of fabrics of parallel fibers, said structures being arranged crossed on the mandrel.

According to another exemplary embodiment, the first winding direction of the inner fibrous structure is parallel to the longitudinal axis of the cylindrical mandrel, the second winding direction of the outer fibrous structure then being oriented at an angle relative to the longitudinal axis of the mandrel.

In this example, the inner fibrous structure may be in the form of a fabric of mutually parallel fibers wound around the cylindrical mandrel parallel to its longitudinal axis, the outer fibrous structure being able to be any structure but, obviously, with the fibers oriented at an angle relative to those of the inner structure which are parallel to the mandrel.

Moreover, the metal wires used can have different diameters, and layers with a plurality of superposed windings of these wires may be provided in alternation with the superposed fibrous structures, the number of which can be greater than two.

The figures of the appended drawing will give a clear understanding as to how the invention can be produced. In these figures, identical references designate similar elements.

BRIEF DESCRIPTION OF THE SEVERAL VIEWS OF THE DRAWINGS

FIGS. 1, 2, 3, 4A, 4B, 4C1, 4C2, 5, 6A, 6B and 7 schematically show the main steps of the method according to the invention, for manufacturing an integral rotationally symmetrical part from composite fibrous structures, FIGS. 4A, 4B, 4C1 and 4C2 presenting various possible outer fibrous structures used after the method step illustrated in FIG. 3, while FIGS. 6A and 6B schematically represent perform treatment outfits for obtaining the part.

DETAILED DESCRIPTION OF THE INVENTION

Figure 7:
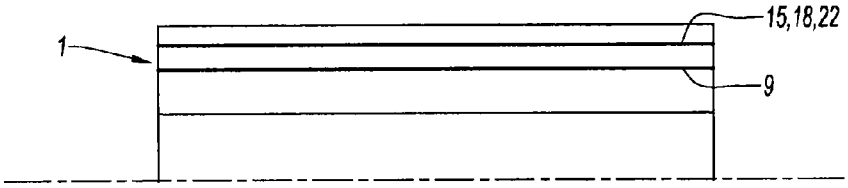

The aim of the method is to manufacture an annular integral rotationally symmetrical part 1, illustrated in FIG. 7, solely from elongate elements in the form of wires, fibers or similar, as will be seen hereafter.

Figure 1:
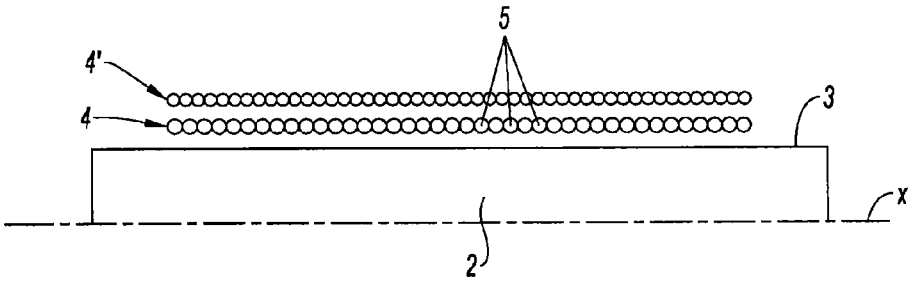

For this, the method consists in using a rotary cylindrical mandrel 2 of longitudinal axis X and in first of all winding, around the lateral surface 3 thereof, in a first step illustrated in FIG. 1, at least one metal wire 4. Given the application of the part 1 to the aeronautical field, the metal wire 4 is produced notably in a titanium alloy of TA6V or 6242 type to provide thermo-mechanical resistance and lightness, and it is obtained in this non-limiting example by wire drawing so as to be able to be available in spool or reel form from which the wire is drawn.

Dimensionally, its diameter depends on the part to be obtained and can, for example, be of the order to a few tenths of a millimeter.

In the example illustrated in FIG. 1, the drawn metal wire 4 is taken from a spool which is not represented and is driven, substantially perpendicularly to the axis X, around the lateral surface 3 of the cylindrical mandrel 2 over a predetermined extent corresponding to the length that is to be obtained, after manufacture, for the rotationally symmetrical part 1, by thus forming a plurality of contiguous turns 5, and over a predetermined plurality of superposed layers 6.

Figure 2:
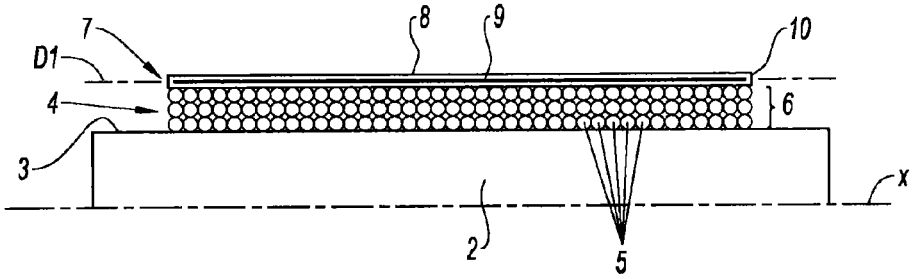

FIG. 2 shows the three layers 6 formed by the windings of contiguous turns 5 of the same metal wire 4 around the mandrel. It would also be possible to use a metal wire 4' such as that shown in cross section in FIG. 1, with a different diameter, less in this case than the diameter of the metal wire 4. This is to show that it is possible to wind metal wires that have distinct diameters.

The method continues with a second step shown in FIG. 2 and consisting in arranging a composite fibrous structure 7 around the drawn metal wire 4.

In this example, the composite fibrous structure 7 takes the form of a fabric 8 of fibers 9 joined together in parallel and made of ceramic (SiC) or of a similar material, coated with metal. The latter and the metal of the drawn wire are of identical nature (as an example, of titanium alloy of TA6V or 6242 type) to optimize the subsequent step of the method concerning the hot isostatic compaction or isothermal forging operation. The fabric 8 of the fibrous structure 7, qualified as inner, since it is turned toward the mandrel, is wound around the metal wire 4 so that the fibers 9 are arranged parallel to the longitudinal axis X of the mandrel 2 (with a zero helix angle), thus defining a first direction D1 of orientation of the fibers of the fabric 8.

As FIG. 2 shows, a single layer 10 of the fabric 8 is formed around the wire 4. Obviously, a winding of a plurality of layers 10 could be provided from the same fabric, even from one or more other distinct fabrics wound concentrically.

Figure 3:
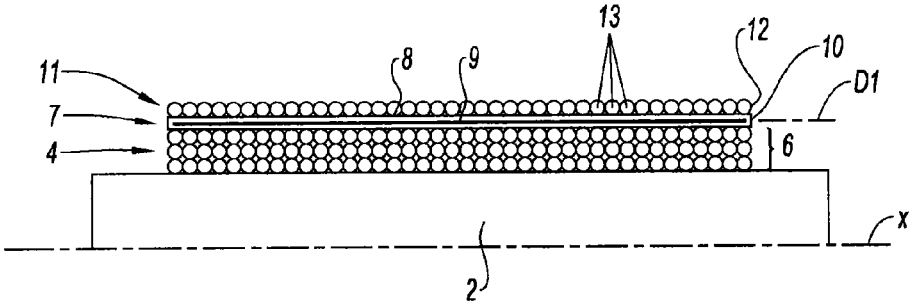

Then, according to a third step of the method illustrated in light of FIG. 3, a drawn metal wire 11 which originates from a spool which is not represented and which is fed in substantially orthogonally to the longitudinal axis X of the rotary cylindrical mandrel 2, is arranged around the fabric 8 of the inner composite fibrous structure 7.

The metal wire 11 forms a single layer 12 of contiguous turns 13 around the fabric 8. A winding of a plurality of layers is once again possible, dependent on the diameter of the wire used and on the separation to be provided between the inner composite fibrous structure 7 and a then outer composite fibrous structure 14 to be superposed as will be see hereinbelow.

The drawn metal wire 11 can be the same (diameter, nature) as that used to form the layers 6 on the mandrel 2 and originate from the same spool. However, it could also have a different diameter.

By virtue of the placement, as inner fibrous structure 7, of a fabric 8 with ceramic fibers 9 parallel to the longitudinal axis X of the mandrel 2, a number of possibilities can be envisaged with regard to the outer fibrous structure 14 to produce, at this stage, a preform E of the integral part to be obtained 1, and these possibilities are shown in FIGS. 4A, 4B, 4C1 and 4C2.

As FIG. 4A shows, the outer fibrous structure 14 is made up of ceramic composite fibers 15, coated with metal, that may or may not be identical to the preceding fibers. These fibers 15 are wound in succession around the turns 13 of the layer 12 of intermediate metal wire 11, which is located, according to the invention, between the two fibrous structures 7 and 14. The fibers 15 are contiguous and oriented in a second direction D2 relative to the axis X of the mandrel 2, forming a helical angle A relative thereto. Thus, the wound fibers 15 and the fibers 9 of the fabric 8 have different respective directions of orientation D1 and D2 that are crossed to allow for the production of rigid, integral, composite rotationally symmetrical parts. Some of the fibers 15 are only partially represented.

The number of wound fibers 15 is variable and is a function of the helical angle A to be given, which is, for example, of the order of 30° to 60°, and of the diameter of the fibers. A single layer 16 of the fibers 15 is made around the metal wire 11. However, a plurality of layers can be envisaged.

Thus, at this stage of the manufacturing method, the two inner 7 and outer 14 fibrous structures are not in direct contact with one another, being separated by the layer of winding of the intermediate drawn metal wire 11 serving as interface, in order to eliminate any excessive stress that might occur between them during the cooling of the preform E formed by the structures and the metal wires.

Instead of the individual composite fibers 15, the outer fibrous structure 14 may be made up of a successive winding of laps or strips 17 each made up of parallel composite fibers 18 (six in this example), that is to say, having a core made of ceramic or of a similar material coated with metal, preferably identical to the drawn wire 11. To keep the fibers 18 of a lap 17 mutually parallel, transversal metal weaving wires 19, of identical nature to the drawn wire, are provided at regular intervals. Here again, the number of laps 17 to cover the layer 12 of intermediate metal wire 11 is dependent on the width of the lap and on the helical angle A thereof relative to the winding axis X of the rotary cylindrical mandrel 2. The helical angle A of the laps defines the second direction D2 of the outer fibrous structure 14, crossing the direction D1 of the inner fibrous structure 7. It can be seen, in FIG. 4B, that two successive identical laps 17 are used to form a single layer 20 of the outer fibrous structure 14. More than one layer 20 could obviously be envisaged. And it goes without saying that the outer fibrous structure 14 covers all of the layer of metal wire 11.

According to another design shown in FIGS. 4C1 and 4C2, the outer fibrous structure 14 takes the form of a fabric 21 with metallic composite fibers 22, assembled together in parallel.

In the example of FIG. 4C1, the fibers 22 are oriented obliquely relative to the perpendicular sides 23, 24 of the fabric 21 in the form of a rectangular strip. In this way, when the fabric 21 is offered up by its corresponding side 23 (small side) parallel to the longitudinal axis X of the cylindrical mandrel 2, it is wound, by the rotation of the latter, over the layer 12 of intermediate drawn wire 11 and these oblique parallel composite fibers 22 form the desired helical angle A defining the second direction D2 of the outer fibrous structure 14, crossed with the first direction D1 of the inner fibrous structure 7. The dimension of the fabric 21 is sufficient to cover all of the layer of drawn wire. A layer 25 (or a plurality of layers if necessary) of fabric 21 is thus wound on the intermediate drawn wire 11.

In the example of FIG. 4C2, the fibers 22 are parallel to the side 23 of the fabric 21 to be wound and are linked together by wires 27. Also, to have a direction of orientation D2 of the fibers that is different from that of D1 of the inner structure, the fabric 21 itself is offered up obliquely by one of its corners 26 relative to the rotary cylindrical mandrel 2, so as to form the desired helical angle A. Thus, the parallel fibers 22 of the fabric 21 are wound around the layer 12 of drawn metal wire 11 in the desired second direction D2, crossed with the first direction D1 of the inner fibrous structure 7, parallel to the axis X of the cylindrical mandrel 2. The dimension of the fabric 21 is such that it makes it possible to cover all of the layer 12 of drawn wire by the winding of said fabric over one or more layers 25.

Thus, whatever the solutions retained, the two fibrous structures 7 and 14 have directions D1, D2 that are crossed and are separated from one another by at least one layer 12 of contiguous turns 13 of the metal wire 11 acting as interface, in accordance with the invention. As for the successive layers making up the two fibrous structures 7 and 14, their fibers are always parallel from one layer to another with an orientation D1 or D2.

Figure 5:
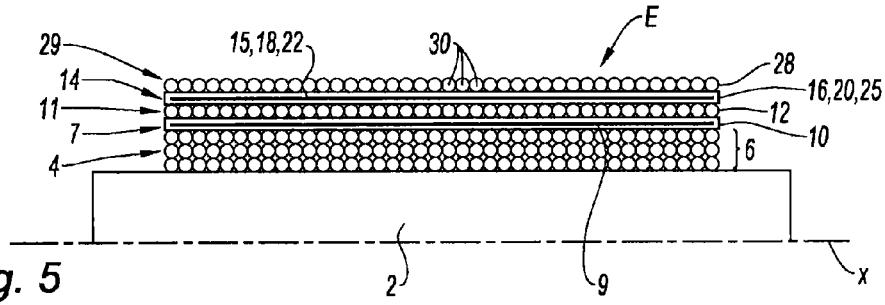

At this stage, as FIG. 5 shows, a subsequent step of the method consists in winding, on the outer fibrous structure 14, at least one layer 28 of drawn metal wire 29 which can be taken from the same feed spool as previously. Thus, a winding with contiguous turns 30 of the wire 29, performed substantially orthogonally to the axis X of the cylindrical mandrel 2, is obtained (as a reminder, wire and/or fabric of metal wires).

Obviously, before this subsequent step, other superposed fibrous structures could be arranged by taking care to alternate between them according to the invention, intermediate layers of metal wire.

A preform E of the rotationally symmetrical part to be produced is obtained, which is constructed only from drawn metal wires 4, 11, 29 and inner and outer structures 7, 14 with composite fibers in individuals, lap, fabric or other form.

Then, as FIG. 6 shows, the preform E is transferred to a compaction outfit 31, schematically represented, where the hot isostatic compression step (CIC) is performed in an isothermal press or in an autoclave (the choice depending in particular on the number of parts to be produced).

However, before its transfer, there can be a step of linking or securing the windings of the metal wire to ensure the cohesion of all of the superposed layers of turns during the transfer to the compaction station. For this, a welding step can be performed, for example an electrical spot welding, on the windings of the visible inner and outer turns. Instead of the welding, foil or leaf, not represented, could be arranged to hold in place the windings of the preform E, welded or not. The latter, if made of a compatible material may they be involved in the manufacture of the part.

Figure 6A:
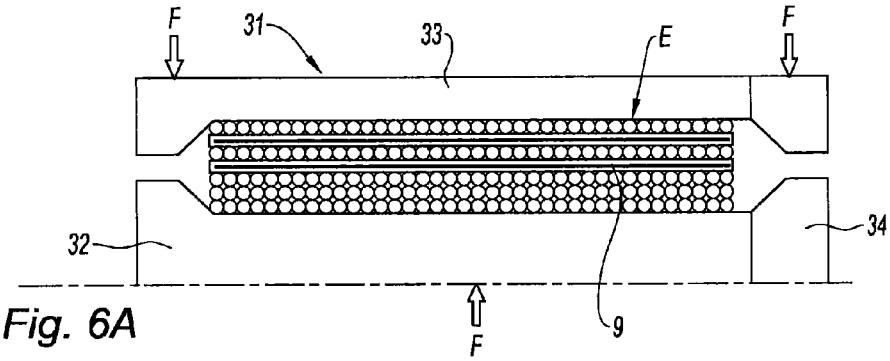

After the preform E has been transferred and placed in the vacuum press outfit 31, FIG. 6A, more particularly in an open cylindrical receptacle 32 of the press, the reception volume of which, defined by its walls 33, corresponds to that of the part to be obtained, the receptacle is closed by a cover 34 of a shape complementing the opening of the receptacle and the transversal face of the preform E facing it.

Under the action of the compression exerted by the plates of the press symbolized by the arrows F on the outfit, and at an appropriate high temperature, the identical metal of the drawn wires 4, 11, 29 and of the cladding of the composite fibers of the structures 7, 14 become pasty eliminating all the empty spaces between the compressed turns, and ultimately densifying the part being obtained by the displacement of the cover relative to the receptacle, without acting on the silicon carbide matrices of the fibers.

Figure 6B:
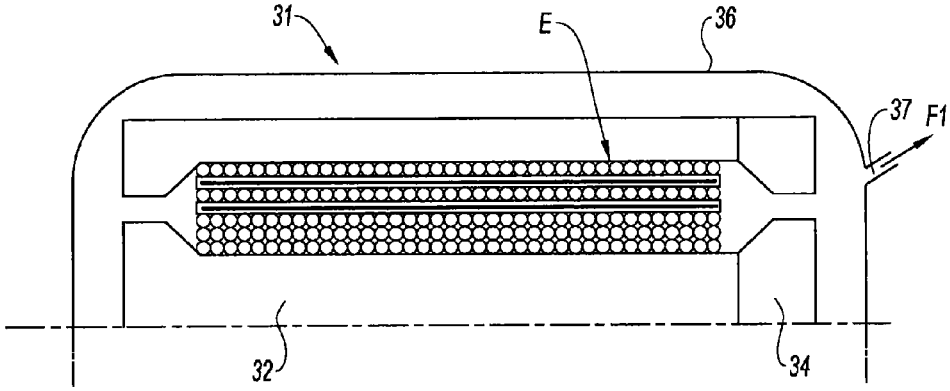

In the variant represented in FIG. 6B of the autoclave outfit 31, the receptacle 32 and the cover 34 with the preform E inside are placed in a deformable pocket 36 made of mild steel which is then introduced into the autoclave of the outfit 31. As an example, this autoclave is raised to an isostatic pressure of 1000 bar and a temperature of 940° C. (for TA6V), so that all of the pocket 36 is deformed, arrows F1, by shrinking through the evacuation of the air expelled through the hole 37 and is pressed against the receptacle 32 and the cover 34 which, in their turn, compress, under a uniform pressure, the windings of wires and fibers until the metal of which they are made (diffusion welding) creeps, as previously.

Thus, after the CIC treatment, cooling and removal from the receptacle have stopped, the composite integral rotationally symmetrical part 1 is obtained, represented in FIG. 7, which is made of titanium alloy of TA6V or 6242 type, with, at its core, the ceramic matrices (silicon carbide, for example) of the fibers 9-15 or 18 or 22 forming crossed reinforcing inserts, but separated by the metal layer derived from the intermediate wire, and the thickness of which is such that it avoids the appearance of stress between the crossed, superposed ceramic fibers. The part 1 can obviously be subjected machining operations after the CIC treatment.

Obviously, the direction of orientation of the fibers of the inner structure could be different from that described above (parallel to the axis of the mandrel), in the same way that the choice of a fabric as inner fibrous structure is in no way mandatory, any other choice being able to be envisaged. The same applies for the outer fibrous structure. It should also be specified that the steps of winding of the wires and of the fibrous structures are performed at ambient temperature without having to use a complex installation.

As examples, the coated composite fibers can be, in addition to SiC/Ti as described above, made of SiC/AI, SiC/SiC, SiC/B, etc. . . .

Dimensionally, the minimum radius of the mandrel is a function of the diameter of the metal wire and should be greater than the latter. The length of the part, for its part, can reach several meters if necessary.

The invention claimed is:

1. A method for manufacturing an integral rotationally symmetrical part by superposition, around a rotary cylindrical mandrel, of at least two metal-coated composite fibrous structures, respectively inner and outer, wound in first and second winding directions crossed on the mandrel, the method comprising:

winding the inner fibrous structure around the mandrel, fibers of the inner fibrous structure being arranged in the first winding direction;

arranging a first layer of metal wire around the inner fibrous structure constructed on the mandrel;

winding the outer fibrous structure around the first layer of wire such that the first layer of metal wire is arranged between the inner fibrous structure and the outer fibrous structure, fibers of the outer fibrous structure being arranged in the second winding direction different from the first winding direction;

placing a preform of the part, formed by the fibrous structures and the layer of metal wire, in a receiving outfit;

applying a hot isostatic compaction or isothermal forging treatment to the preform placed in the receiving outfit; and extracting a treated preform from the outfit.

2. The method as claimed in claim 1, wherein the metal wire is obtained by wire drawing.

3. The method as claimed in claim 1, wherein the superposed winding layers of the metal wire and of the fibrous structures are made cold, at ambient temperature.

4. The method as claimed in claim 1, wherein the layer of metal wire is wound substantially orthogonally to the longitudinal axis of the rotary cylindrical mandrel.

5. The method as claimed in claim 1, wherein a second layer of metal wire, on which the inner fibrous structure is subsequently wound, is arranged around the cylindrical mandrel, before the winding the inner fibrous structure.

6. The method as claimed in claim 1, wherein a third layer of metal wire is arranged around the outer fibrous structure.

7. The method as claimed in claim 1, wherein the first winding direction of the inner fibrous structure is oriented at an angle relative to the longitudinal axis of the cylindrical mandrel, the second winding direction of the outer fibrous structure being oriented symmetrically to the first relative to a direction at right angles to the longitudinal axis of the mandrel.

8. The method as claimed in claim 7, wherein the inner and outer fibrous structures are in a form of individual and parallel fibers wound in succession around the mandrel, or in a form of laps or strips of parallel fibers, or in a form of fabrics of parallel fibers, the structures being arranged crossed on the mandrel.

9. The method as claimed in claim 1, wherein the first winding direction of the inner fibrous structure is parallel to the longitudinal axis of the cylindrical mandrel, the second winding direction of the outer fibrous structure being oriented at an angle relative to the longitudinal axis of the mandrel.

10. The method as claimed in claim 9, wherein the inner fibrous structure is in a form of a fabric of mutually parallel fibers wound around the cylindrical mandrel parallel to its longitudinal axis, the outer fibrous structure having the fibers oriented at an angle relative to those of the inner structure which are parallel to the mandrel.

* * * * *